US010750893B2

(12) United States Patent
Dean

(10) Patent No.: US 10,750,893 B2
(45) Date of Patent: Aug. 25, 2020

(54) APPARATUS AND MAILBOX ASSEMBLY FOR INDICATING MAIL STATUS

(71) Applicant: George K. Dean, Lancaster, KY (US)

(72) Inventor: George K. Dean, Lancaster, KY (US)

( * ) Notice: Subject to any disclaimer, the term of this patent is extended or adjusted under 35 U.S.C. 154(b) by 66 days.

(21) Appl. No.: 16/150,006

(22) Filed: Oct. 2, 2018

(65) Prior Publication Data

US 2019/0099029 A1 Apr. 4, 2019

Related U.S. Application Data

(60) Provisional application No. 62/566,704, filed on Oct. 2, 2017.

(51) Int. Cl.
*A47G 29/12* (2006.01)

(52) U.S. Cl.
CPC .. *A47G 29/121* (2013.01); *A47G 2029/12105* (2017.08)

(58) Field of Classification Search
CPC ..... A47G 29/121; A47G 29/1225; A47G 2029/12105; A47G 2029/1229
USPC ..... 232/35
See application file for complete search history.

(56) References Cited

U.S. PATENT DOCUMENTS 3,026,024 A * 3/1962 Holmgren ..... A47G 29/121 232/35
3,026,025 A * 3/1962 Hanson ..... A47G 29/121 232/35
3,318,516 A * 5/1967 Scheerer ..... A47G 29/121 232/35
3,675,845 A * 7/1972 Scheerer ..... A47G 29/121 232/35
3,889,874 A * 6/1975 Arwood ..... A47G 29/121 232/35
4,706,880 A * 11/1987 Peters ..... A47G 29/121 232/35
4,836,441 A * 6/1989 Crider ..... A47G 29/121 232/34
4,877,180 A * 10/1989 Shull ..... A47G 29/121 232/35
4,986,467 A * 1/1991 Bibbee ..... A47G 29/121 232/34
5,201,465 A * 4/1993 Limehouse ..... A47G 29/121 232/35
5,927,596 A * 7/1999 Trenier ..... A47G 29/121 232/17
7,178,715 B1 2/2007 Dean
7,337,945 B1 * 3/2008 Riggs ..... A47G 29/121 232/35
9,565,961 B1 * 2/2017 Kirschner, Sr. ..... A47G 29/121
2002/0152949 A1 * 10/2002 Turner ..... A47G 29/121 116/284
2005/0274784 A1 * 12/2005 Mullins ..... A47G 29/121 232/35

* cited by examiner

*Primary Examiner* — William L Miller
(74) *Attorney, Agent, or Firm* — King & Schickli, PLLC

(57) ABSTRACT

A mailbox assembly includes a mailbox and a mail status indication feature. The mail status indication feature or apparatus includes a base, an indicator arm carried on the base and displaceable between a home position, a first deployed position and a second deployed position and an adjustment feature for releasably holding the indicator arm in the home position, the first deployed position and the second deployed position.

20 Claims, 11 Drawing Sheets

APPARATUS AND MAILBOX ASSEMBLY FOR INDICATING MAIL STATUS

This application claims to benefit a U.S. provisional patent application Ser. No. 62/566,704 filed on 2 Oct. 2017, the full disclosure of which is incorporated herein by reference.

TECHNICAL FIELD

This document relates generally to the postal equipment field and, more particularly, to a new and improved apparatus and mailbox particularly adapted for indicating the mail status of the mailbox in an easy-to-use, simple and efficient manner.

BACKGROUND

This document relates to a mailbox assembly as well as to an apparatus for use with a mailbox that is adapted for simply and efficiently indicating the mail status of the mailbox including not only when mail is present in the box for pickup by the mailman but also indicating when mail has been left by the mailman for pickup by the mailbox owner and still further indicating when the mailbox is empty. Advantageously, the mailbox assembly and the mail status indication feature or apparatus are inexpensive to make and very simple to use.

SUMMARY

In accordance with the purposes and benefits as described herein, an apparatus or mail status indication feature is provided. That apparatus comprises (a) a base, (b) an indicator arm carried on the base and displaceable between a home position, a first deployed position and a second deployed position and (c) an adjustment feature for releasably holding the indicator arm in the home position, the first deployed position and the second deployed position.

The adjustment feature may include a guide carried on the base and a locking tab carried on the indicator arm. Further, the guide may include a first stop, a second stop and a third stop. That first stop may correspond to the home position, the second stop may correspond to the first deployed position and the third stop may correspond to the second deployed position.

The guide may comprise a plate. The first stop may be a first aperture in the plate. The second stop may be a second aperture in the plate. The third stop may be an open notch in the plate.

The base of the apparatus may include a receiver having an internal cavity. In such an embodiment the adjustment feature may include a biasing element received and held within the internal cavity. Further, the adjustment feature may include a slide block held in the internal cavity and a fastener connecting a proximal end of the indicator arm to the slide block. The biasing element may comprise a compression spring concentrically received over the fastener and compressed between the slide block and the guide at an end of the receiver.

Still further, the apparatus may include a reflector carried on a distal end of the indicator arm. In addition, the base may further include a support anchored to a mailbox. An address marker may be carried on the support.

In accordance with an additional aspect, a mailbox assembly is provided. That mailbox assembly comprises a mailbox including a box body and a door connected by a hinge to the box body. The mailbox assembly also includes a mail status indication feature including (a) a base, (b) an indicator arm carried on the base and displaceable between a home position, a first deployed position and a second deployed position and (c) an adjustment feature for releasably holding the indicator arm in the home position, the first deployed position and the second deployed position.

The adjustment feature may include a guide carried on the base and a locking tab carried on the indicator arm. Further, the guide may include a first stop, a second stop and a third stop. The first stop may correspond to the home position. The second stop may correspond to the first deployed position. The third stop may correspond to the second deployed position. Still further, the guide may be a plate and the first stop may be a first aperture in the plate. The second stop may be a second aperture in the plate. The third stop may be an open notch in the plate.

Still further, the base may include a receiver having an internal cavity. In such an embodiment, the adjustment feature may include a biasing element received and held within the internal cavity. Further, the adjustment feature may include a slide block held in the internal cavity and a fastener connecting a proximal end of the indicator arm to the slide block. The biasing element may comprise a compression spring concentrically received over the fastener and compressed between the slide block and the guide.

In the following description, there are shown and described several preferred embodiments of the apparatus and the mailbox assembly. As it should be realized, the apparatus and the mailbox assembly are capable of other, different embodiments and their several details are capable of modification in various, obvious aspects all without departing from the apparatus and the mailbox assembly as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the apparatus and the mailbox assembly and together with the description serve to explain certain principles thereof.

Figure 1A:
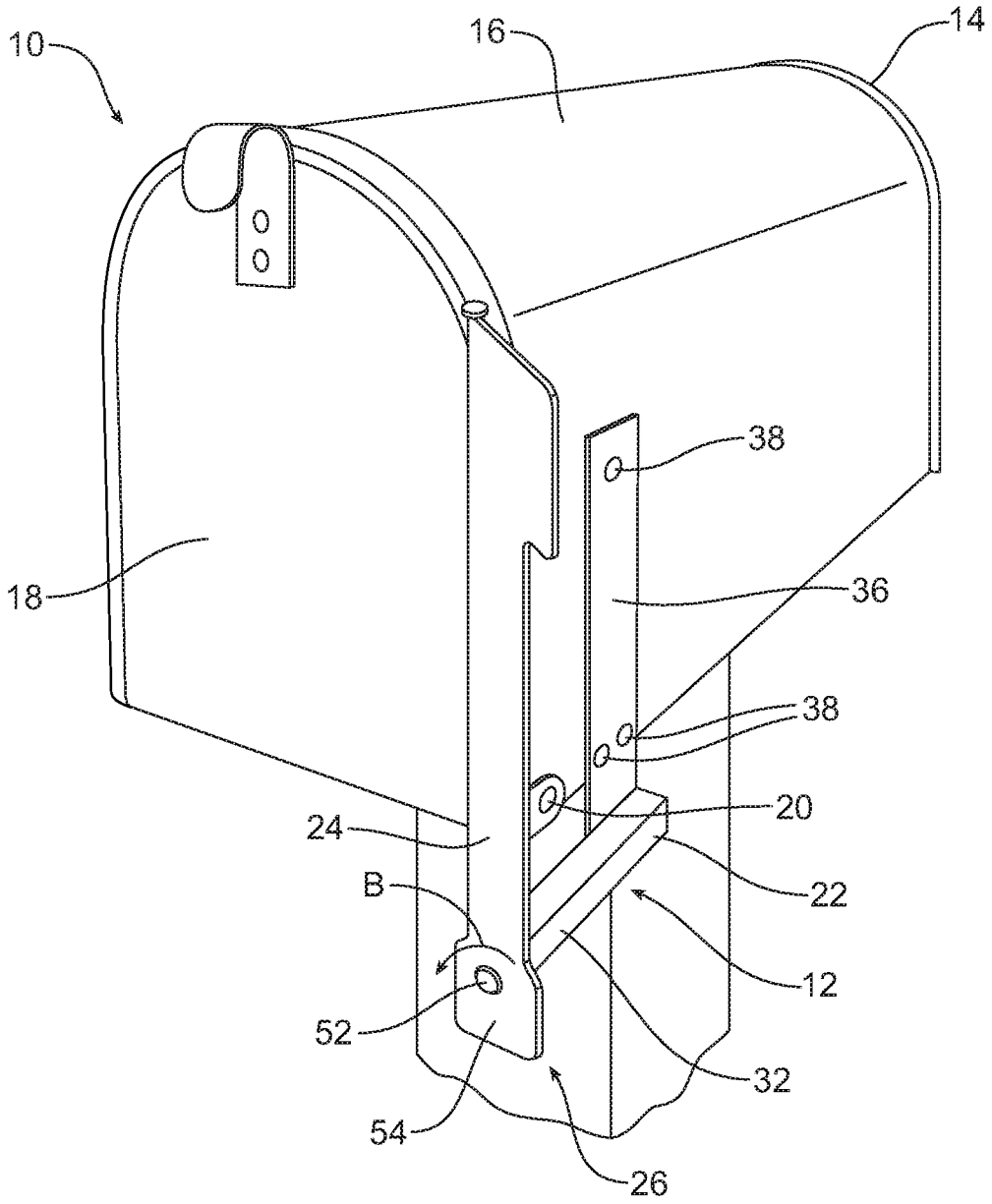
FIG. 1A is a front perspective view of the mailbox assembly illustrating the indicator arm of the mail status indication feature or apparatus in the home position.

Reference will now be made in detail to the present preferred embodiments of the apparatus and mailbox assembly, examples of which are illustrated in the accompanying drawing figures.

DETAILED DESCRIPTION

Reference is now made to the drawing figures illustrating the new and improved mailbox assembly 10 incorporating new and improved apparatus 12 in the form of a mail status indication feature. The mailbox assembly 10 includes a mailbox 14 having a box body 16 and a door 18 connected by a hinge 20 to the box body 16.

Figure 2A:
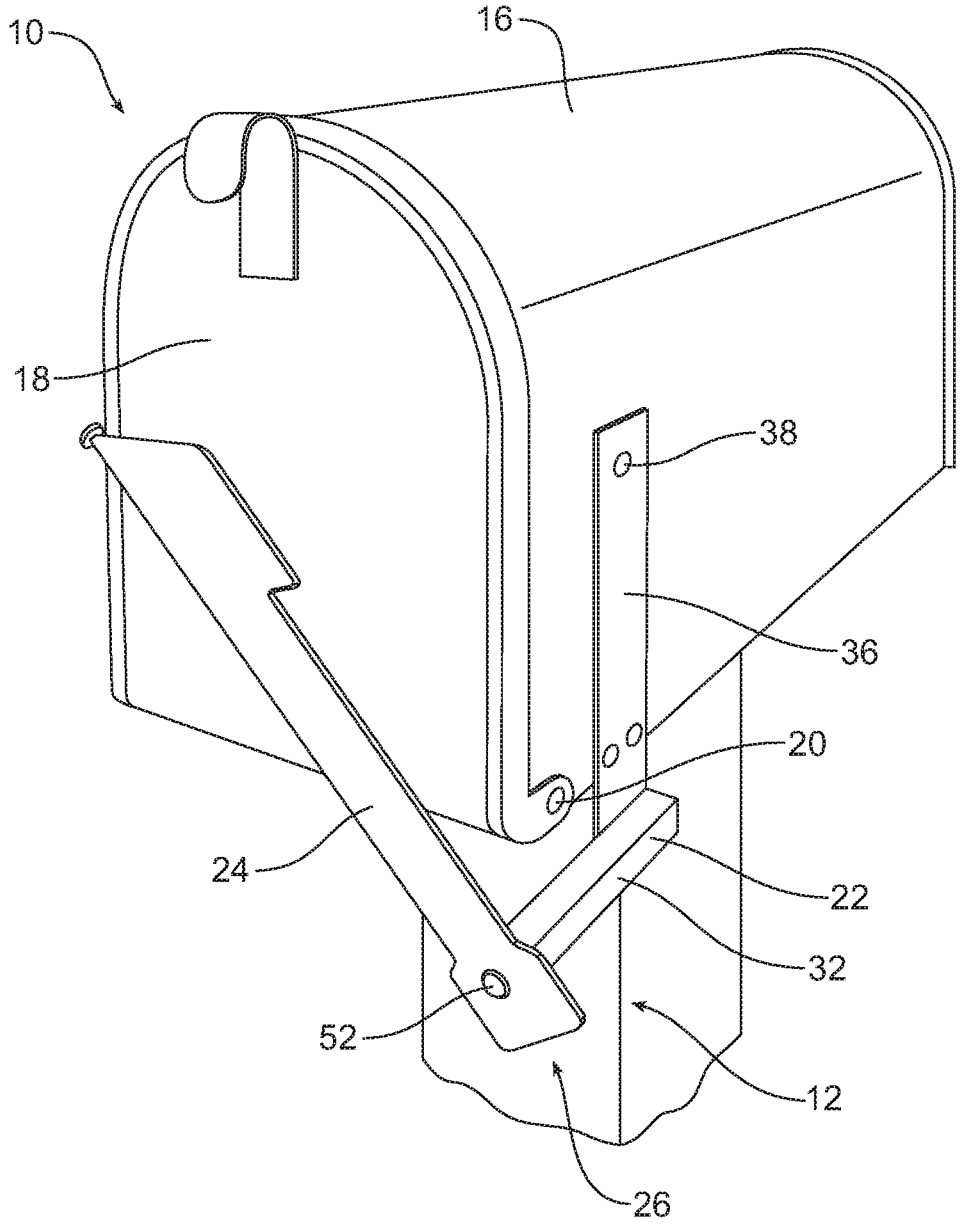
FIG. 2A is a front perspective view of the mailbox assembly illustrating the indicator arm of the mail status indication feature or apparatus in the first deployed position.
Figure 3A:
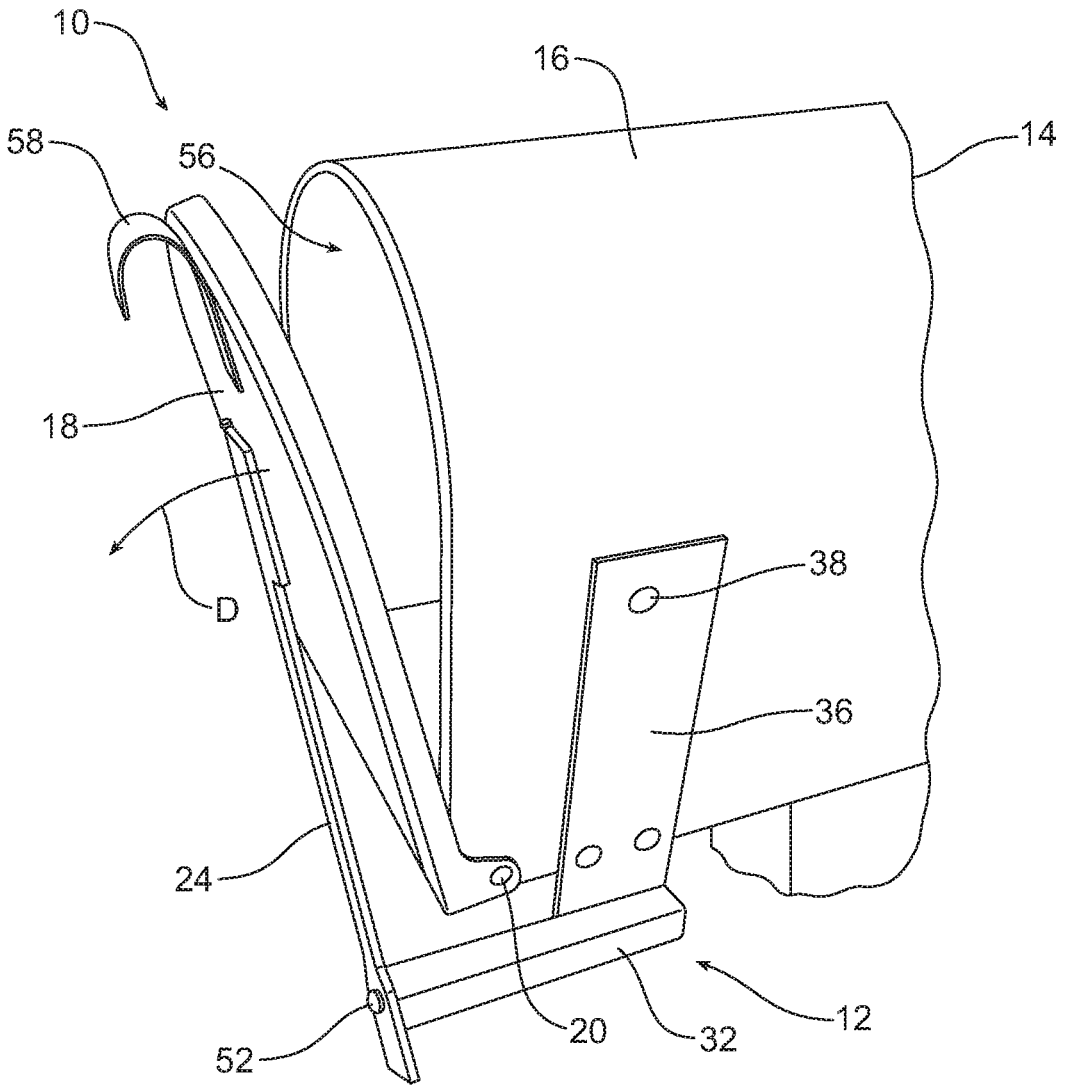
FIG. 3A is a perspective view illustrating the opening of the door on the mailbox assembly into engagement with the indicator arm of the mail status indication feature or apparatus shown in the first deployed position.
Figure 4A:
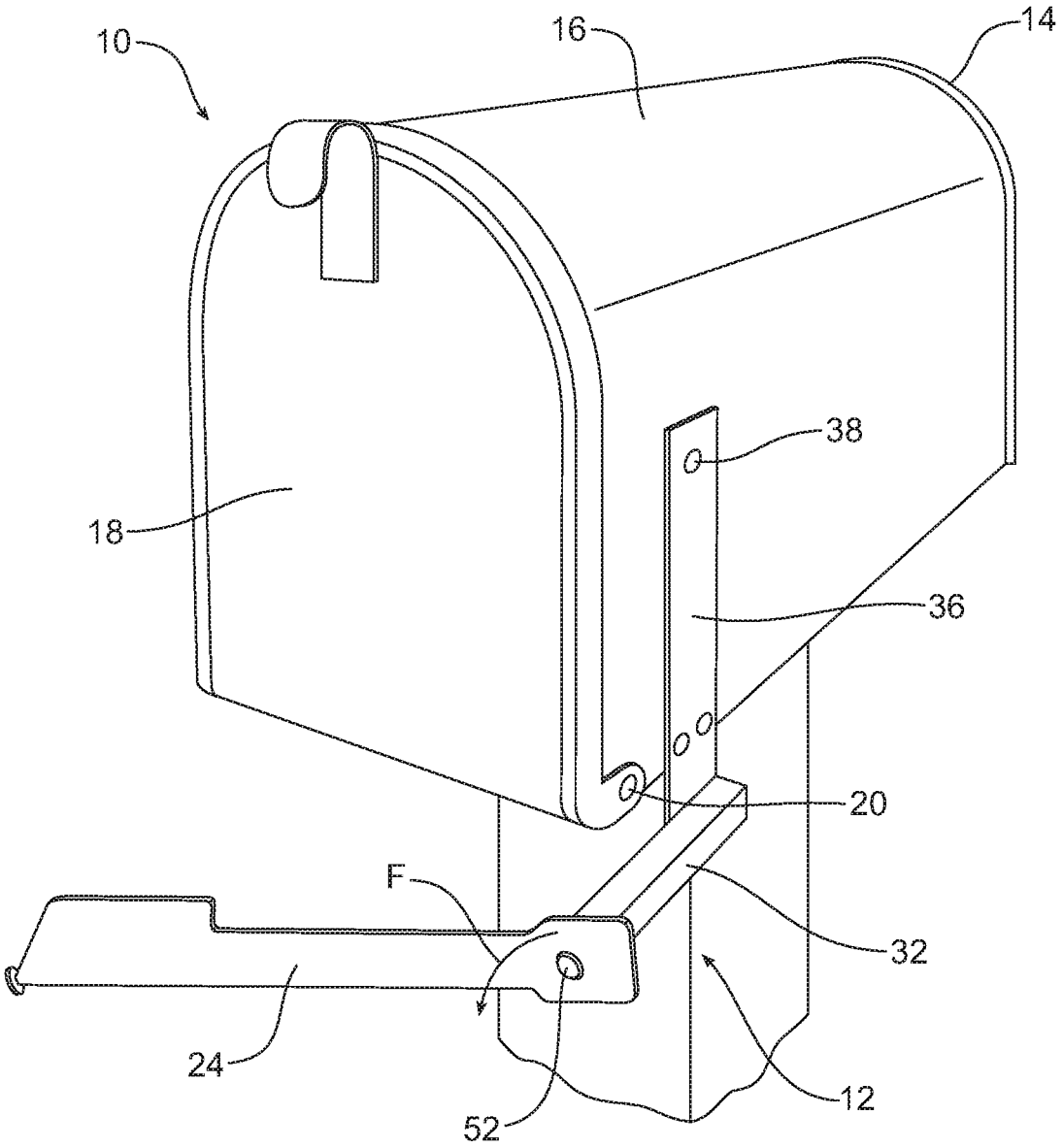
FIG. 4A is a front perspective view of the mailbox assembly illustrating the indicator arm in the second deployed position.

The mail status indication feature or apparatus 12 includes (a) a base 22, (b) an indicator arm 24 carried on the base and displaceable between a home position illustrated in FIG. 1A, a first deployed position illustrated in FIGS. 2A and 3A, and a second deployed position illustrated in FIG. 4A and (c) an adjustment feature, generally designated by reference numeral 26 for releasably holding the indicator arm in the home position, the first deployed position and the second deployed position.

As best illustrated in FIGS. 1B, 1C, 2B, 3B, and 4B, the adjustment feature 26 includes a guide 28 carried on the base 22 and a locking tab 30 carried on the indicator arm 24. More particularly, in the illustrated embodiment, the base 22 includes a receiver 32 having an internal cavity 34 and a support 36 anchored by fasteners 38 or other means to a sidewall of the box body 16.

Figure 1B:
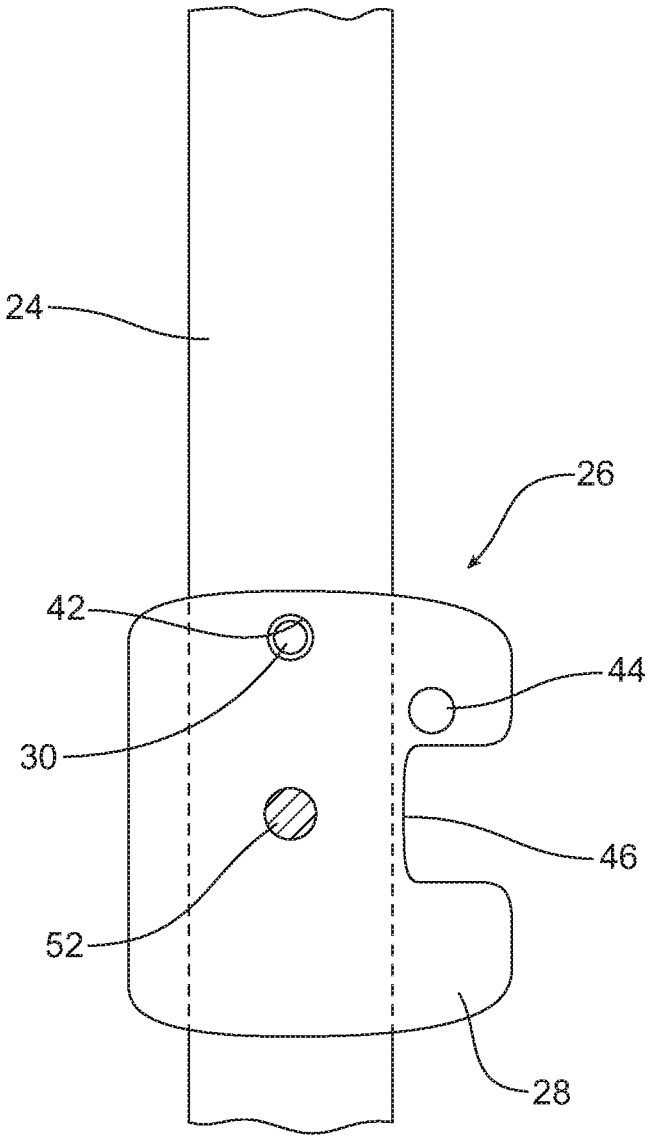
FIG. 1B is a detailed plan view of the guide and the indicator arm in the home position.
Figure 1C:
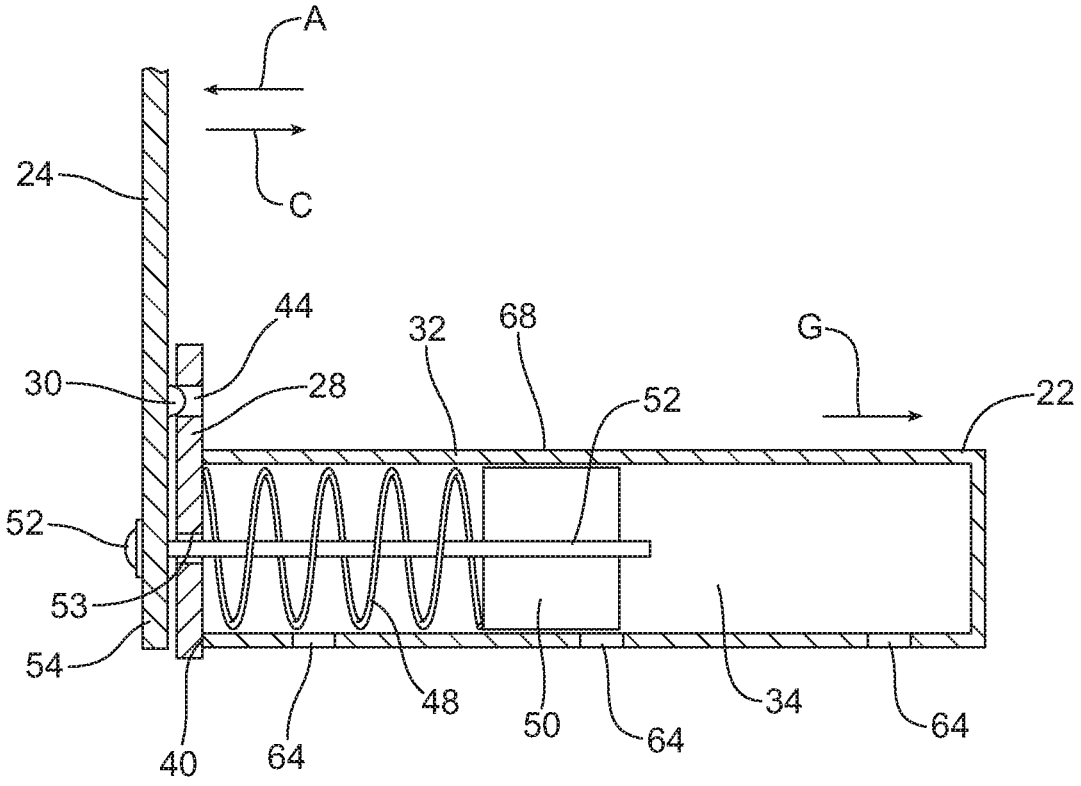
FIG. 1C is a cross sectional view of the adjustment feature and the receiver of the base when the indicator arm is in the home position.
Figure 2B:
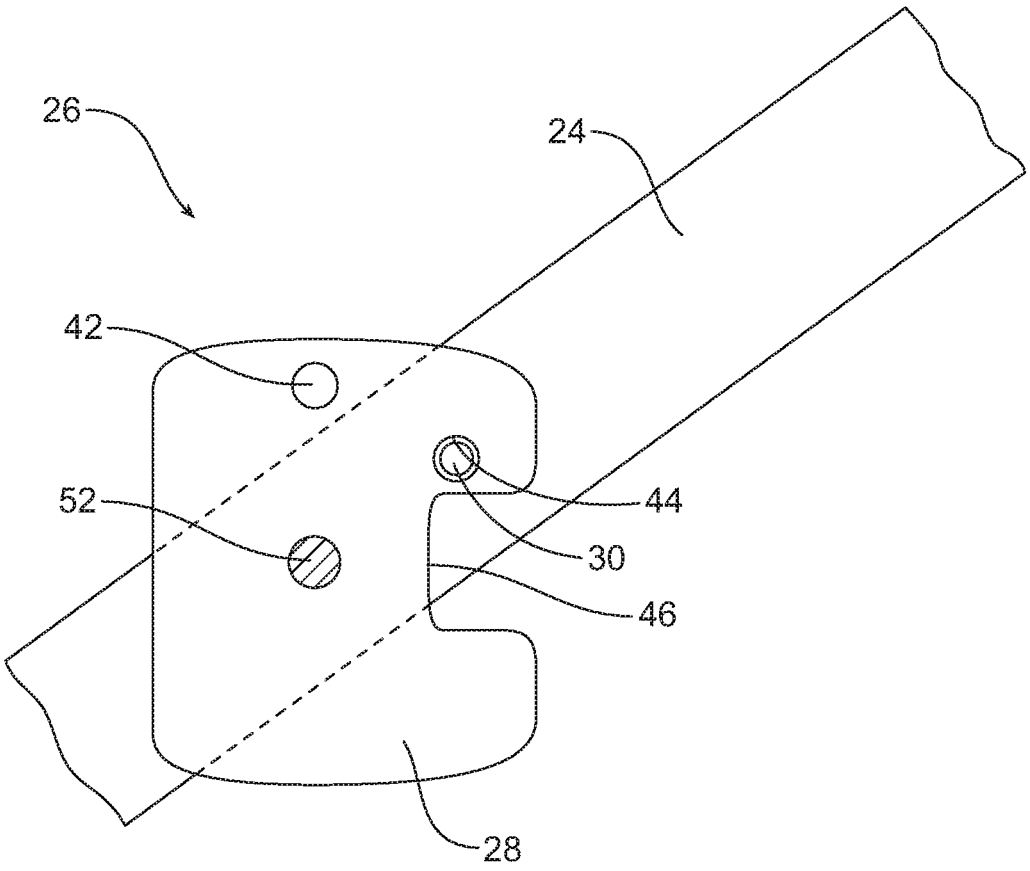
FIG. 2B is a detailed plan view of the guide and the indicator arm in the first deployed position.
Figure 4B:
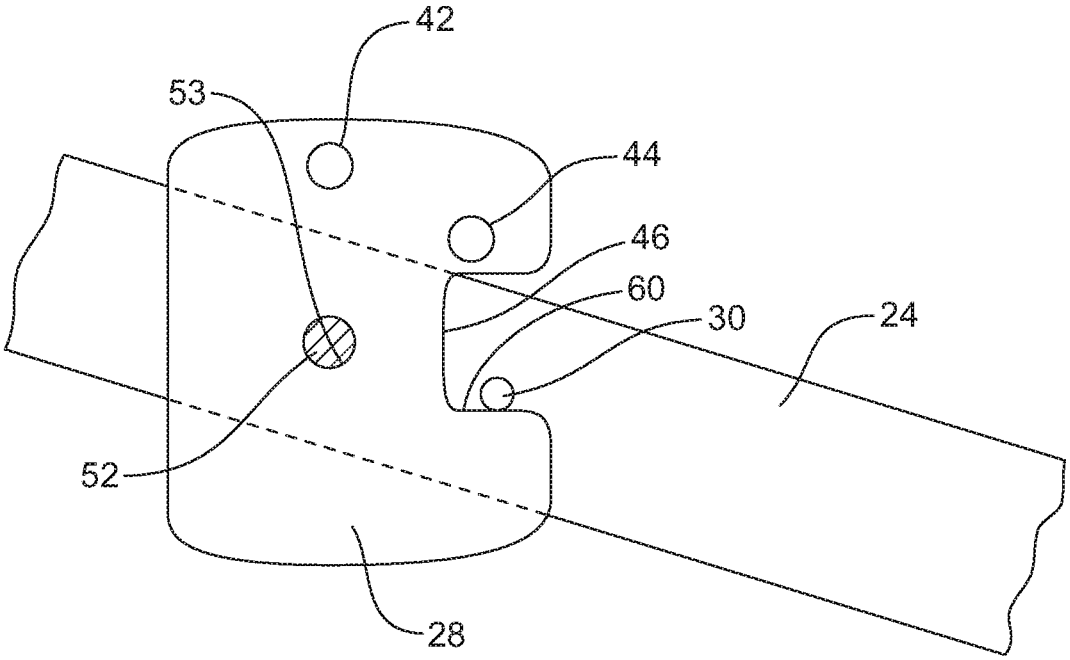
FIG. 4B is a detailed plan view of the guide and the indicator arm in the second deployed position as illustrated in FIG. 4A.

As illustrated in the drawing figures, the guide 28 may take the form of a plate secured to one end 40 of the receiver 32. As illustrated, the guide includes a first stop 42, a second stop 44 and a third stop 46. In the illustrated embodiment the first stop 42 is a first aperture in the plate or guide 28, the second stop 44 is a second aperture in the plate or guide and the third stop 46 is an open notch in the plate or guide. As illustrated in FIGS. 1A-1C, the first stop 42 corresponds to the home position. As illustrated in FIGS. 2A and 2B, the second stop 44 corresponds to the first deployed position. As illustrated in FIGS. 4A and 4B, the third stop 46 corresponds to the second deployed position.

Figure 3B:
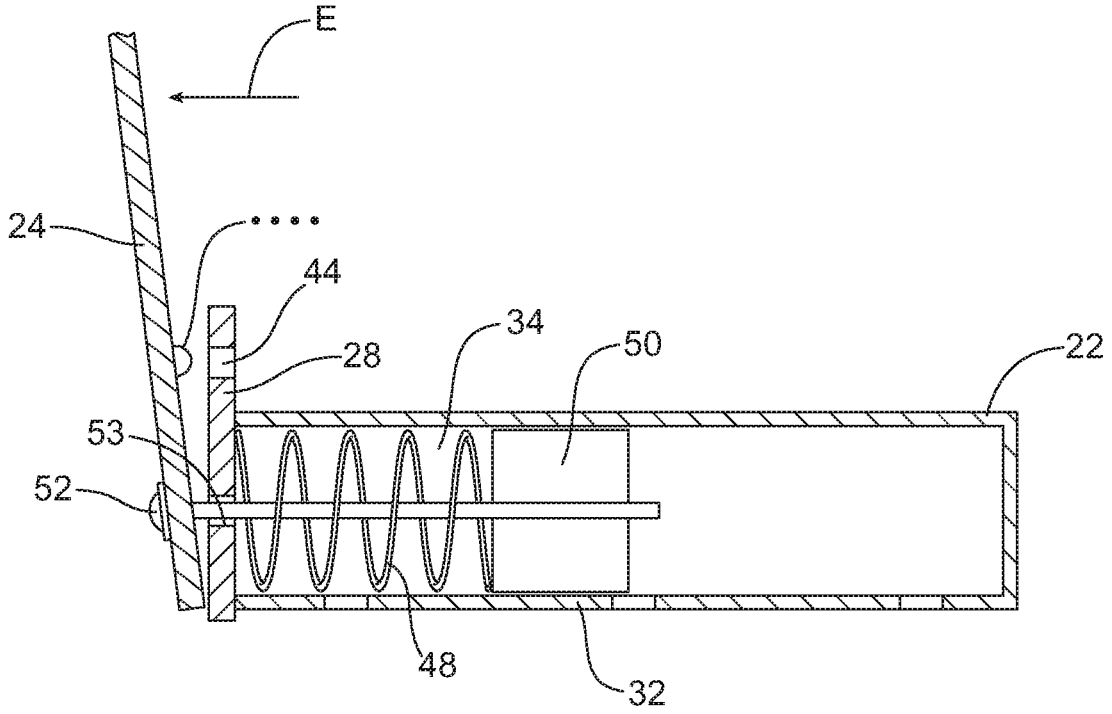
FIG. 3B is a view similar to FIG. 1C illustrating how the indicator arm is shifted in the direction of action arrow A to free the locking tab on the indicator arm from the second aperture in the guide when the mailbox door engages the indicator arm as illustrated in FIG. 3A.

As best illustrated in FIGS. 1C and 3B, the adjustment feature 26 also includes a biasing element 48, received and held within the internal cavity 34 of the receiver 32. Further, the adjustment feature 26 includes a slide block 50 held in the internal cavity 34 of the receiver 32 and a fastener 52, in the form of a screw, passing through an aperture 53 in the plate 28 and connecting a proximal end 54 of the indicator arm 24 to the slide block 50. Here it should be noted that in the illustrated embodiment, the biasing element 48 comprises a compression spring concentrically received over the fastener 52 and compressed between the slide block 50 and the guide 28.

When the mailbox assembly 10 is empty, the indicator arm 24 is placed in the home position illustrated in FIGS. 1A-1C. As illustrated, when the indicator arm 24 is in the home position, the locking tab 30 on the indicator arm is received in the first stop 42 of the guide 28.

When one wishes to mail a letter, one opens the door 18 of the mailbox 14, inserts the letter into the storage compartment 56 within the box body 16, closes the door 18 and displaces the indicator arm 24 from the home position illustrated in FIG. 1A to the first deployed position illustrated in FIG. 2A. As illustrated in FIG. 3B, in order to do this one displaces the indicator arm 24 in the direction of action arrow A (note FIG. 1B) against the biasing force of the biasing element 48 until the locking tab 30 is free of the first stop 42. The indicator arm 24 is then rotated in the direction of action arrow B (note FIG. 1A) about the fastener 52 until the locking tab 30 is aligned with the second stop 44 in the guide 28. If only light pressure is applied to the indicator arm 24 by the operator, when the locking tab 30 is fully aligned with the second stop 44, the biasing force of the biasing element 48 draws the arm in the direction of action arrow C until the locking tab is fully engaged in the second stop 44 which functions to hold the indicator arm in the first deployed position illustrated in FIG. 2A. When the indicator arm 24 is in the first deployed position, the indicator arm provides a visual indication that the mailbox 14 includes a letter or other mail to be picked up by the postman for mailing to another party.

When the postman arrives at the mailbox assembly 10, he grasps the handle 58 on the door 18 and pivots the door open about the hinge 20 in the direction of action arrow D. See FIG. 3A. Once the door 18 engages the indicator arm 24, the indicator arm 24 is displaced outward from the mailbox 14 freeing the locking tab 30 from the second stop 44 in the guide 28 (see FIG. 3B and note action arrow E). As a result, the indicator arm 24 is drawn downward by the force of gravity and the further opening of the door 18. Here it should be appreciated that the indicator arm 24 continues to pivot in this direction (note action arrow F in FIG. 4A) until the locking tab 30 engages the bottom edge of the third stop 46 (see FIG. 4B). At this point the indicator arm 24 is held in the second deployed position illustrated in FIGS. 4A and 5.

Figure 5:
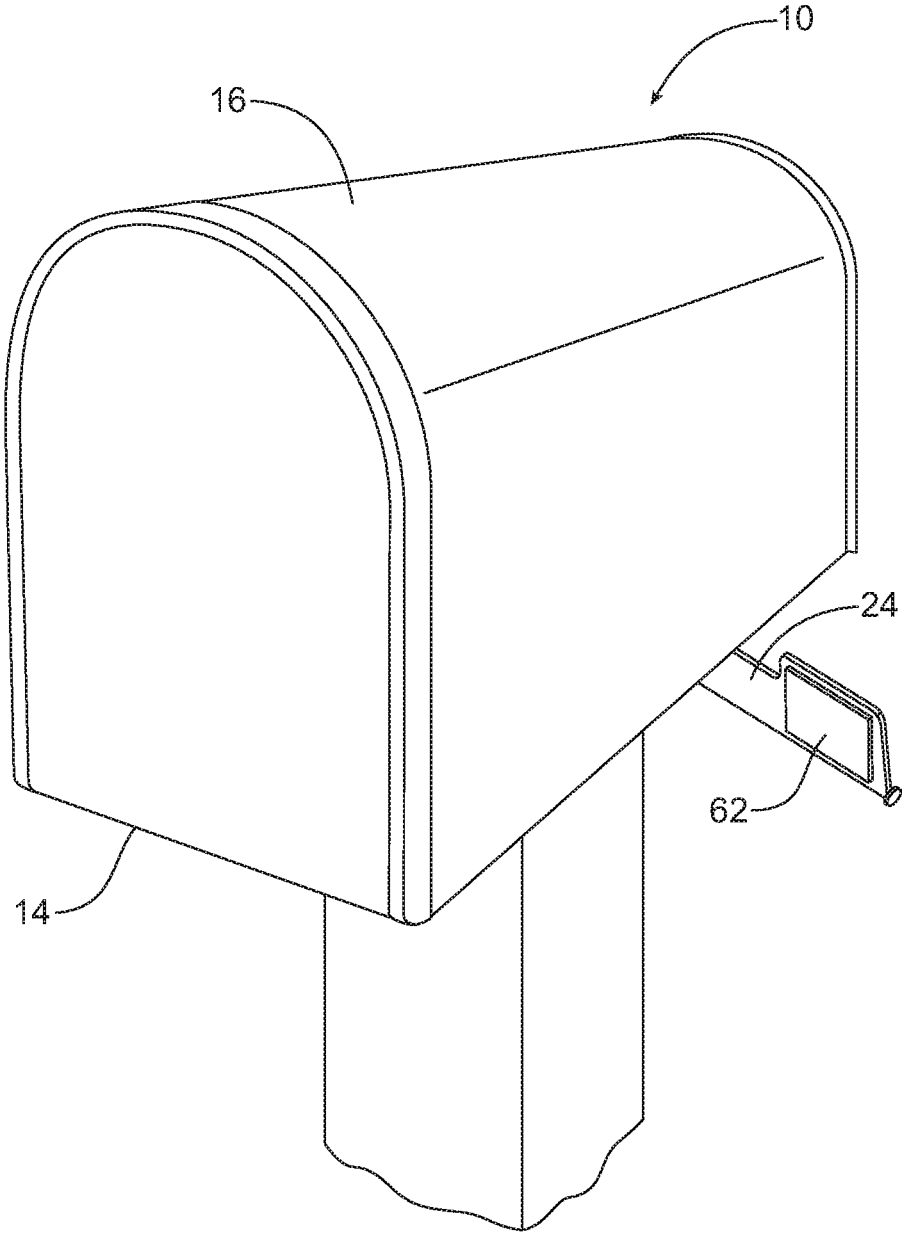
FIG. 5 is a rear perspective view of the mailbox assembly when the indicator arm is in the second deployed position.

The mailman may then remove the letter to be mailed from the mailbox 14 and then insert the mail being delivered into the mailbox before closing the door 18. Now the position of the indicator arm 24 in the second deployed position indicates to a user that delivered mail is in the mailbox. As illustrated in FIG. 5, a reflector 62 may be provided on the rear face of the distal end of the indicator arm 24. Such a reflector may be easily seen by one viewing the mailbox assembly 10 from a house located behind the mailbox. Thus, one within the house may easily look out upon the mailbox assembly 10 and note the reflector 62 when the indicator arm 24 is in either the home position, illustrated in FIG. 1A and indicating an empty mailbox, or in the second deployed position illustrating a mailbox including delivered mail. In the event the person in the house cannot see the reflector, that is an indication that the indicator arm 24 is still in the first deployed position and the letter being mailed has not yet been picked up by the postman.

In the event the postman delivers mail to an empty mailbox 14 with the indicator arm 24 in the home position, after inserting the delivered mail into the box body 16 and closing the door 18, the postman displaces the indicator arm 24 from the home position illustrated in FIG. 1A to the second deployed position illustrated in FIG. 4A. This provides the homeowner with an easily visible indication from inside the home when the postman has delivered mail to the mailbox.

The foregoing has been presented for purposes of illustration and description. It is not intended to be exhaustive or to limit the embodiments to the precise form disclosed. Obvious modifications and variations are possible in light of the above teachings. For example, as illustrated in FIG. 1C, the receiver 32 may include water drain holes 64 in the bottom wall thereof. Further, the receiver 32 may include a slight fall in the direction of action arrow G to allow water to drain by gravity from the top wall 68 thereof.

Figure 6A:
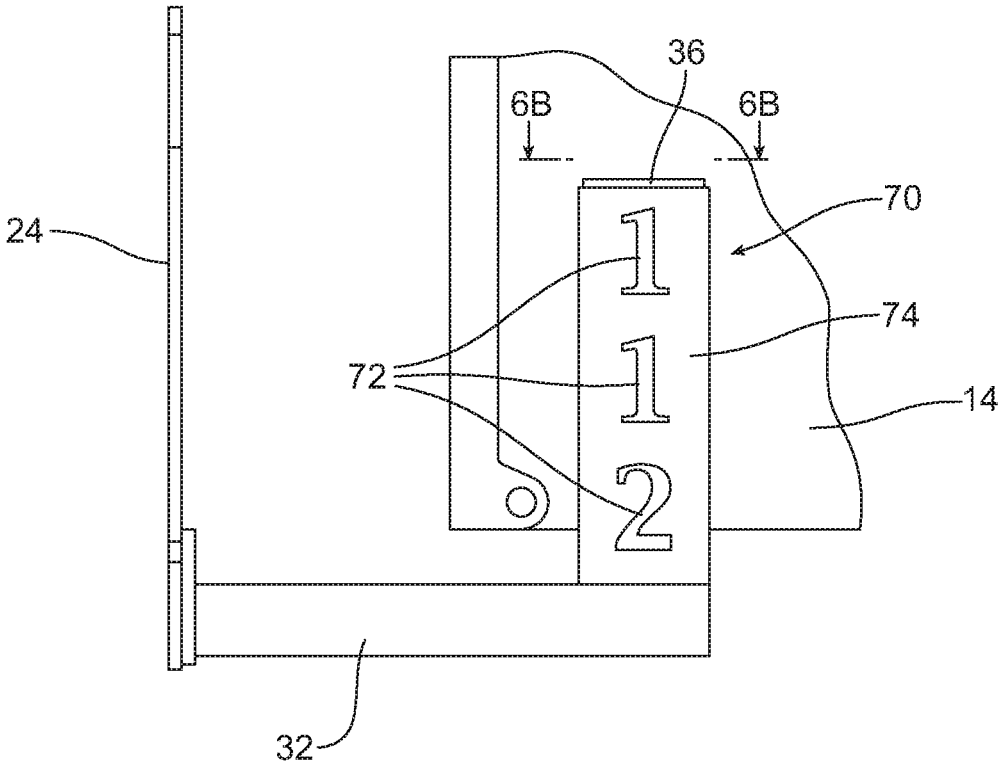
FIG. 6A is a front elevational view of an address marker carried on the support of the apparatus.
Figure 6B:
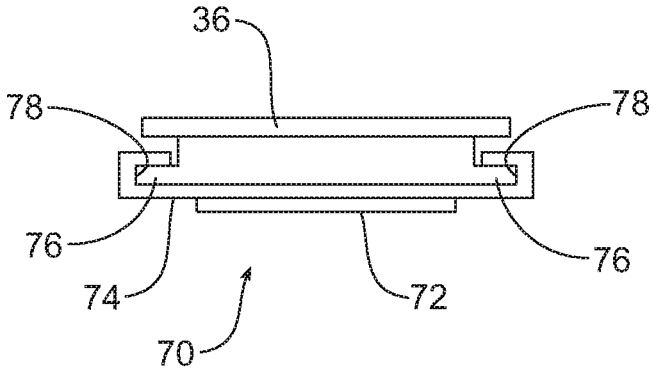
FIG. 6B is an end elevational view illustrating the cooperating opposed lugs on the support and the opposed channels on the decorative plate of the address marker received over those lugs.

Further, as illustrated in FIGS. 6A and 6B, an address marker 70 comprising indicia 72 carried on a decorative plate 74 may be received or secured over the support 36. Toward this end, the support 36 may include opposed lugs 76 that are received and engaged by opposed channels 78 carried on the rear of the decorative plate 74.

All such modifications and variations are within the scope of the appended claims when interpreted in accordance with the breadth to which they are fairly, legally and equitably entitled.

What is claimed:

1. A mail status indication apparatus for a mailbox, the apparatus comprising:

a base;

an indicator arm carried on said base and displaceable relative thereto between a home position, a first deployed position and a second deployed position; and an adjustment feature for releasably holding said indicator arm in said home position, said first deployed position and said second deployed position.

2. The apparatus of claim 1, wherein said adjustment feature includes a guide carried on said base and a locking tab carried on said indicator arm.

3. The apparatus of claim 2, wherein said guide includes a first stop, a second stop and a third stop.

4. The apparatus of claim 3, wherein said first stop corresponds to said home position, said second stop corresponds to said first deployed position and said third stop corresponds to said second deployed position.

5. The apparatus of claim 4, wherein said guide is a plate and said first stop is a first aperture in said plate, said second stop is a second aperture in said plate and said third stop is an open notch in said plate.

6. The apparatus of claim 5, wherein said base includes a receiver having an internal cavity.

7. The apparatus of claim 6, wherein said adjustment feature includes a biasing element received and held within said internal cavity.

8. The apparatus of claim 7, wherein said adjustment feature includes a slide block held in said internal cavity and a fastener connecting a proximal end of said indicator arm to said slide block.

9. The apparatus of claim 8, wherein said biasing element comprises a compression spring concentrically received over said fastener and compressed between said slide block and said guide.

10. The apparatus of claim 9, further including a reflector carried on a distal end of said indicator arm.

11. The apparatus of claim 10, wherein said base further includes a support anchored to the mailbox.

12. The apparatus of claim 11, further including an address marker carried on said support.

13. A mailbox assembly, comprising:

a mailbox including a box body and a door connected by a hinge to said box body; and a mail status indication feature including (a) a base, (b) an indicator arm carried on said base and displaceable relative thereto between a home position, a first deployed position and a second deployed position, and (c) an adjustment feature for releasably holding said indicator arm in said home position, said first deployed position and said second deployed position.

14. The mailbox assembly of claim 13, wherein said adjustment feature includes a guide carried on said base and a locking tab carried on said indicator arm.

15. The mailbox assembly of claim 14, wherein said guide includes a first stop, a second stop and a third stop.

16. The mailbox assembly of claim 15, wherein said first stop corresponds to said home position, said second stop corresponds to said first deployed position and said third stop corresponds to said second deployed position.

17. The mailbox assembly of claim 16, wherein said guide is a plate and said first stop is a first aperture in said plate, said second stop is a second aperture in said plate and said third stop is an open notch in said plate.

18. The mailbox assembly of claim 17, wherein said base includes a receiver having an internal cavity.

19. The mailbox assembly of claim 18, wherein said adjustment feature includes a biasing element received and held within said internal cavity.

20. The mailbox assembly of claim 19, wherein said adjustment feature includes a slide block held in said internal cavity and a fastener connecting a proximal end of said indicator arm to said slide block and wherein said biasing element comprises a compression spring concentrically received over said fastener and compressed between the slide block and the guide.

* * * * *